United States Patent [19]

Trost

[11] Patent Number: 4,798,244

[45] Date of Patent: Jan. 17, 1989

[54] TOOL AND PROCESS FOR STIMULATING A SUBTERRANEAN FORMATION

[76] Inventor: Stephen A. Trost, 7120 S. Nut Tree, Salt Lake City, Utah 84121

[21] Appl. No.: 74,223

[22] Filed: Jul. 16, 1987

[51] Int. Cl.[4] ..... E21B 43/263

[52] U.S. Cl. ..... 166/250; 166/299; 166/303; 166/308; 102/313; 102/317; 299/13

[58] Field of Search ..... 166/63, 250, 259, 262, 166/299, 302, 305.1, 303, 308; 299/13; 102/313, 317

[56] References Cited

U.S. PATENT DOCUMENTS

| | | | |
|---|---|---|---|
| 1,758,358 | 5/1930 | Ennis | 102/317 |
| 4,064,935 | 12/1977 | Mohaupt | 166/63 |
| 4,081,031 | 3/1978 | Mohaupt | 166/63 |
| 4,184,430 | 1/1980 | Mock | 102/313 |
| 4,279,304 | 7/1981 | Harper | 166/63 |
| 4,391,337 | 7/1983 | Ford et al. | 166/299 |
| 4,530,396 | 7/1985 | Mohaupt | 166/63 |
| 4,537,255 | 8/1985 | Regalbuto et al. | 166/299 |

FOREIGN PATENT DOCUMENTS

| | | | |
|---|---|---|---|
| 1051221 | 10/1983 | U.S.S.R. | 166/63 |

OTHER PUBLICATIONS

S. A. Makowski, R. E. Dockter, K. R. Sites, *Midas Probe Model DP-132,* Aug. 18, 1986.

*Primary Examiner*—George A. Suchfield
*Assistant Examiner*—Terry L. Melius
*Attorney, Agent, or Firm*—M. Reid Russell

[57] ABSTRACT

A high energy gas fracturing tool for radially fracturing a rock formation in a well bore consisting of a cylindrical canister that is holed to pass gas and is for housing a stack of propellant modules that are selected to provide a desired burn rate when ignited. Each propellant module mating face is angled from the horizontal between forty-five (45) to seventy-five (75) degrees, and the modules are bonded together with an epoxy resin wherein propellant or explosive particles are mixed, the resin to exhibit burn characteristics similar to those of the propellant stack. The tool, additional to the propellant containing canister, an ignitor rod and explosive device for igniting the propellant stack, mounts a bull head end over a lower end and a reverse thruster assembly that is connected to the canister upper end. The reverse thruster assembly includes a housing with nozzles formed therein that are angled from the vertical to pass gas on propellant deflagration, creating thereby a force against the tool lifting during propellant burning. Above the reverse thruster assembly is arranged a pressure pulse monitor that is battery powered to operate a pressure transducer for sensing pressure pulses at the tool. The monitor to turn on when a sufficient strength of pressure pulse is received, to store pressure pulses sensed over time, with the stored pressure data retrieved when the tool is removed from the well bore. The recorded pressure pulse data is used for determining the dynamic window of the formation, whereat, at a certain pressure over time the formation will be optimally radially fractured. The tool is suspended from the surface on a wire line and includes a collar locator for locating it at a certain level within the well bore.

35 Claims, 6 Drawing Sheets

TOOL AND PROCESS FOR STIMULATING A SUBTERRANEAN FORMATION

DESCRIPTION OF THE INVENTION

1. Field of the Invention

The invention relates to devices for stimulating a subterranean formation surrounding a well by fracturing that formation utilizing a deflagrating propellant charge and specifically involves a propellant assembled from propellant modules selected to provide required pressure and volume of gas when burned to optimally fracture the rock surrounding that well bore.

2. Background

Flow of a fluid such as oil or gas through a porous medium, such as a rock formation, is a function of the permeability of that formation. If permeability can be increased, more fluid can be recovered. It is well known that over the life of an oil or gas well, with continued pumping or draining of the oil or gas from that well, the permeability of the surrounding rock formation may be insufficient to justify economically continued production, even though a larger percentage of hydrocarbons remain. At this point the operator can either abandon the well or can attempt to increase the permeability of that rock formation, so as to rejuvenate the flow. There are currently a number of techniques or processes for mechanically increasing permeability. The best known four processes are: (1) hydraulic fracturing; (2) explosive fracturing; (3) acidizing; and (4) high energy gas fracturing.

Hydraulic Fracturing increases formation permeability by a slow introduction by pumping of a highly viscous fluid into the area of a well bore between packings. Fluid pressure is steadily increased until the tensile strength of that rock material is exceeded. At that point a fracture will be initiated that propagates from opposite sides of the well bore into the formation as a biwing fracture. This fracture is induced at a point of least resistance in the rock material. A fluid used in practicing such method is one selected to be sufficiently viscous to enable the suspension and mass transport of proppants therein. Such proppant materials are either sand grains or grains of a synthetic material and are to pass into and settle in the induced fracture. So arranged, the proppants keep the induced fracture from totally closing once the pressure on the fluid is reduced and the normal closing pressures of the rock formation are reexerted. Hydraulic fracturing generally involves the generation of the single biwing fracture that extends as a vertical plane from opposite sides of the well bore into the formation. In such fracturing, the injected fluids will, by in large, remain in the formation, and the proppants used to prop the fracture may, due to compaction, actually come to restrict the permeability of that formation. Also, and of major consideration in selecting a fracturing process, the equipment and labor involved in hydraulic fracturing is extensive and, of course, of significant expense.

Explosive fracturing

In an attempt to overcome the limitations of hydraulic fracturing where, generally, a single biwing fracture only is produced, explosives have been used for dynamically loading a rock formation. Because of the speed of burning of an explosive, and the shock wave produced thereby, it has been found that explosive compaction of the formation rock around the well bore opposite to the explosion may decrease rather than increase the formation permeability. Therefore, while explosive fracturing may provide a greater circumferencial fracturing effect in a rock formation, such may also depredate the formation to the point where most, if not all, permeability is lost. Explosive fracturing is therefore generally considered to be unreliable.

Acid Fracturing

This is a process utilized to increase permeability by dissolving reactive materials of a rock formation to create conductive "worm holes" and for etching fracture faces. Most commonly used acids are concentrated solutions of hydrofluoric and hydrochloric, which can, of course, create serious safety problems in their transport and conveyance to a desired location in a well bore. Further, acidizing is limited by a danger of formation matrix collapse due to excessive rock dissolution near the well bore through a preferential invasion of acid into zones of high rather than low permeability. Of course, depth of penetration is limited by the type of rock in the formation and acid strength. Such acidizing processes have been found to cause extensive damage to the well bore due to geochemical reactions and therefore the nature of the materials at the location where the fracture is to be induced must be identified prior to selection of the acid to be used. Where such unwanted geochemical reactions take place, they can create damage, even to a loss of permeability, and of course, the retrieval and disposal of the acid is a major difficulty.

High Energy Gas Fracturing

Propellant deflagration is a recent technology that has been developed to produce a good distribution of fractures from around a well bore without the problems that have been inherent in explosive and acid processes. In practice, high energy is created by a deflagrated propellant that is ignited in a well bore adjacent to a formation to be fractured to produce gas under pressure and water as the products of combustion that are near sonic velocities. The propellant can be burned radially from a longitudinal center cavity within the propellant or can be burned from one end as a cigarette burn, or a combination of both can be employed. In practice, high energy gas fracturing involves a canister containing a propellant that is spotted adjacent to a perforated wall of a well bore in the zone where increased permeability is desired. To ignite the propellant, wherein an ignitor rod is implanted, an electrical current is transmitted from the surface to detonate an instantaneous electric blasting cap which initiates deflagration thereof in a period of milliseconds. A high volume of pressurized gas and water is generated at near sonic velocities. By such deflagration, the energy loading in the well bore will be much faster than occurs during hydraulic fracturing to thereby create multiple fractures in directions other than the plane of least resistance. The propellant is selected to burn at a far slower rate than occurs in an explosive detonation. No destructive shock wave will therefore be generated in propellant deflagration as could cause crumbling of the material around the well bore. It is in the area of high energy gas fracturing that the present invention is directed.

3. Prior Art

High energy gas fracturing devices usually include a cylinder or canister arrangement for containing a propellant and ignitor that is suspended from a wire line, or the like, for lowering into a well bore. The cylinder or canister is arranged for spotting opposite to a location in the well bore where the casing has been appropriately perforated. So positioned, the propellant is ignited from the surface, as by passing an electrical signal from the surface down the wire line to the ignitor assembly initiating thereby deflagration of the propellant producing a high volume of pressurized gas to radially fracture the formation around that well bore. Some examples of such arrangements are shown in patents by Mohaupt, U.S. Pat. No. 3,174,545; Mohaupt, U.S. Pat. No. 3,264,986; and Mohaupt, U.S. Pat. No. 3,422,760. These patents deal with explosive particles or granules mixed in a matrix producing a propellant that has a controlled length of time of combustion to produce a high volume of gas at pressure.

Similar to such earlier devices, the present invention includes a cylinder or canister for lowering into a well bore on a wire line that includes a propellant that is ignited from the surface by an electrical current that is passed into an ignitor arranged with the propellant. The present invention, distinct therefrom, provides for a selection of propellant from propellant modules to produce a certain time or rate of burn. The rate of burning directly correlates to the pressurization rate which controls the effectiveness of the fracturing attempt. The propellant modules are stacked together and bonded together to burn simultanelously producing a certain volume and pressure of gas at a specific time that will be at the dynamic window for the particular rock matrix surrounding that well bore. Also, neither of these devices involves an arrangement for sensing the pressure changes within the formation as occur with propellant deflagration over time which data is retrieved when the tool is retrieved and is for use in determining the formation dynamic window. Similarly, another patent by Mohaupt, U.S. Pat. No. 4,064,935, shows a like approach for generating a high volume and pressure of gases over time but does not involve forming a propellant charge from propellant modules stacked and bonded together or an arrangement for sensing and retrieving pressure information during propellant deflagration as does the present invention.

An additional patent by Ford, et al., U.S. Pat. No. 4,391,337, provides for a controlled or directed high volume of gas under pressure with the use of shaped explosive charges that are oriented within the well bore before firing. So arranged, the shaped charge tends to confine the force of explosion to a desired point or location within that well bore to provide a fracturing that may or may not cause crumbling of the rock therearound. This arrangement is unlike the present invention in both structure and function.

Except for the Ford, et al. patent, all of the patents cited above are similar to the present invention only in that they employ propellants in a matrix that burn to generate a high volume of gas under pressure in a certain time so as to provide a fracturing of the rock surrounding a well bore. Additionally, the present invention provides a capability for constructing and modifying a propellant stack from propellant modules at the well location to produce a volume and pressure of gas at a time certain to be within the dynamic window for the specific rock matrix or formation to be fractured. Nor do such earlier arrangements provide a pressure measuring monitor for inclusion with the propellant tool for lowering into the well bore to sense pressure over time, which monitor is retrieved with the tool and the pressure information recorded therein used to determine whether or not the propellant design was within the dynamic window and, if not, to allow for the selection and ignition of a second proper propellant that is assembled in the field to assume operation within the dynamic window. Such pressure measurement over time is used for determining the success of that particular fracturing effort and for producing data for use in determining the dynamic window for this and other well bores in the formation for optimally programming the propellant selection for well bore fracturing.

Still another and later patent by Mohaupt, U.S. Pat. No. 4,530,396, is shown to involve a device consisting of a canister supported on a wire line and carrying a precast propellant with a center longitudinal ignitor that is arranged to be ignited by a blasting cap to burn in both cigarette fashion and radially outwardly from a center cavity. The propellant is designed and cast to provide a peak gas pressurization rate near ignition, and thereafter progress into a slower pressurization rate but with a high volume of gas to extend the fractures initiated by the faster burning propellant. This propellant composition, however, is based upon the empirical understanding of the formation characteristics which may or may not be accurate and once designed is fabricated at the factory and shipped to the field location for use. This arrangement, therefore, does not have the flexibility of the present invention that allows for propellant composition selection at the field location allowing the deflagrating propellant to produce a gas volume and pressure at a time certain that is optimal for the dynamic window of the particular rock formation. Further, the device of this Mohaupt U.S. Pat. No. 4,530,396, does not, as does the present invention, provide instrumentation for measuring and recording pressure changes as occur in a well bore fracture attempt, which data is then retrieved with the tool and used to determine whether a fracture attempt was successful and for use in determining an optimum propellant configuration for use in this and other well bore fracturing attempts within the particular formation.

As set out above, the present invention provides a pulse monitor device that is physically connected to and travels with the propellant casing for pressure changes as occur during propellant deflagration. The pulse monitor provides for sensing and recording of critical pressure rates as are generated in such oil well recovery enhancement operations. The monitor will record generated pressure pulses for later retrieval by a computer when the assembly is brought back to the surface after operation. The monitor, to provide this data, contains a pressure transducer, with internal signal conditioning and data acquisition circuitry. The unit is set up to trigger upon receipt of pressure pulses and to digitize those pulses for storage in an internal memory. The unit is arranged to operate on an internal battery and therefore no external wires are required for power control. The pressure pulse monitor of the present invention has features and aspects in common with a probe designed and built by SAIC, known as Model DP-132, MIDAS PROBE. Distinct therefrom, however, the present invention has arranged it's circuitry to fit within a long, thin cylindrical casing that has been ruggedized to withstand the pressures and acceleration and deceleration forces expected to be generated during propellant deflagration, providing for automatic triggering on receipt of a pressure pulse over a certain set intensity, and is constructed in separate and distinct sections.

Additionally, unlike the earlier cited devices, the present invention employs a reverse thruster assembly connected to the propellant carrier that includes upwardly angled jets or nozzles allowing for a small percentage of expanding gas from the propellant deflagration to be directed to maintain the device as positioned within the well bore prohibiting it from being propelled upwardly by the propellant burning and then dropped back to its original position in the well bore after the expanding gases have subsided.

SUMMARY OF THE INVENTION

It is a principal object of the present invention to provide a device that includes a wire line mounted carrier wherein are contained a stack of selected propellant modules that are ignited to deflagrate so as to provide a pressure and volume of gas over a certain time to assure the radial fracturing of a rock formation at a certain depth in a well bore based upon formation data.

It is another object of the present invention to provide propellant modules or sections for assembly into a propellant stack that are selected to provide a composite propellant that, when ignited, will deflagrate to provide a desired volume and pressure of gas that is at subsonic velocity, the deflagrating propellant to produce a buildup of gas pressure over time that is within the dynamic window for a particular formation.

It is another object of the present invention to provide precase propellant modules or segments that each include a center longitudinal cavity or hole, which holes will align when the modules are stacked to form a longitudinal center hole to accommodate an ignitor rod fitted therethrough, the modules being dimensionally identical to one another, each module having a uniformly sloping concave under surface that accommodates and closely fits to nest with a flat cone upper surface of another module, which modules are preferably cemented together using a resin that has been sensitized with a flat-burning propellant that, when burned with the propellant, will provide burn characteristics that are like those of the propellant, the module junction thereby presenting a continuation of a flame front burning through the modules.

Still another object of the present invention is to provide, for inclusion with the cylindrical carrier wherein the propellant stack is contained, a reverse thruster assembly that includes a plurality of equidistant holes that are angled from the vertical and are for directing gas under pressure up the well bore opposite to a lifting force as is applied to the tool during propellant ignition.

Still another object of the present invention is to provide an assembly for connection to a bottom end of the tool carrier for guiding and centralizing the assembly on a wire line into a well bore.

Still another object of the present invention is to provide a pulse monitor assembly for inclusion with the tool assembly that is capable of sensing and recording pressure pulses over time as are generated from propellant ignition and during deflagration.

Still another object of the present invention is to provide a pulse monitor assembly arranged for mounting in a ruggedized carrier for inclusion with the other tool components to record pressure pulses as they are sensed and to store that data for later transfer as to a microcomputer or other data processor after the tool is withdrawn from the well bore after fracturing.

Still another object of the present invention is to provide a wire line tool for lowering into a well bore to where the well bore casing has been perforated, the tool configured such that, after the propellants contained therein are burned, it can be retrieved for reloading with a new propellant charge and reused.

The present invention is a radial fracturing tool that includes a cylindrical carrier that is constructed and has appropriate dimensions to track down a cased well bore. The tool carrier contains a cast propellant that is preferably assembled from pre-formed propellant sections or modules. Each such propellant section or module is formed to be dimensionally like another having the same radius and a longitudinal center hole therethrough, but is chemically distinct to accelerate or retard the rate of deflagration to assure pressure rates within the dynamic window. Each module is cast to have a uniform upwardly angled conical upper or top face and a mating or matching concave undersurface or face. So arranged, the modules will closely nest together providing a tight contact between their respective abutting surfaces. The angle of the convex and concave surfaces is selected between forty-five degrees (45°) and seventy-five degrees (75°) and is preferably sixty degrees (60°), thereby providing a tight fitting sloping surface, between the propellant module faces, which close surface contact encourages a flame front to burn uniformly thereacross. To further provide that uniform burning, an epoxy resin is selected for it's adhesive and burn characteristics that has mixed therein fast burning propellant chips or flakes. This epoxy resin mixture is used to join the propellant modules and is intended to, as nearly as possible, duplicate the burn characteristics of the stack of propellant modules. So arranged, the modules each have a center opening and are assembled in a stack to have a longitudinal center opening or cavity therethrough. This opening or cavity is to receive an ignitor rod fitted therethrough. The ignitor rod is preferably an aluminum rod containing a fast burning propellant. The ignitor rod is ignited from a blasting cap that is arranged at the head end thereof. The ignitor rod provides propellant ignition along that propellant longitudinal center opening, the propellant then burning radially. Further, the igniting of the blasting cap initiates also a cigarette type burn from the propellant end.

The propellant containing carrier is perforated at intervals over its length opposite to the propellant stack, the holes to pass the gas under pressure generated in propellant deflagration. The carrier holes function as nozzles to direct the turbulent subsonic gas flow horizontally through the well bore casing perforation and into the surrounding rock formation, fracturing that rock material and eroding rock material by shear forces from the fracture face which will provide a natural propant for the fracture to prevent closure.

The propellant carrier end that is for lowering into a well bore includes a forward or bull nose that is tapered outwardly and is flat across the nose face, appearing as a flattened cone and by it's shape is intended to travel around obstructions in the well bore as it may encounter as the tool is lowered on a wire line into a well bore. The carrier maintains a constant distance of the tool from the side of the well bore particularly during ignition so as to uniformly distribute the generated gas under pressure radially from the tool casing. A hanger assembly is provided for suspending the propellant stack within the carrier, which hanger assembly is preferably a cast aluminum "Y". The "Y" lower side is secured in a top propellant module. the "Y" upper sides are each holed to receive an aluminum pin fitted therethrough and through a cable end. Whereby, the propellant stack is supported in pendulum fashion within the carrier.

The tool casing upper end is arranged to couple to receive a reverse thruster assembly that consists of an inwardly sloping cap wherearound are strategically drilled holes, each of which holes is formed into the cap at approximately a fifteen degree (15°) angle to the vertical. During propellant deflagration some of the produced gases are directed out of these angled holes to force the tool downwardly against a lifting force as may be applied against the tool carrier during the propellant burning.

The tool includes, for arrangement above the reverse thruster assembly, a pulse monitor section, the upper end of which section connects to a collar locator for sensing tool positioning in the well bore that includes a hanger assembly wherefrom the tool is suspended from a wire line to the surface. The pulse monitor section consists of a cylindrical housing wherein is contained circuitry for sensing, processing and retaining pressure pulses as are produced during propellant deflagration. This section is ruggedized to withstand the forces produced in the well bore during propellant burning, the circuitry arranged to receive and be activated when the first pressure pulse is received. The pressure pulse rates are then recorded for immediate retrieval and interpretation when the tool is pulled from the well bore after use are used to provide for field modification of the propellant modules. The pulse monitor circuitry is arranged to store the sensed pulse rates for retrieval by connection to a personal computer, or like system, for permanent recording and interpretation. The pulse monitor system is essential for determining, from the recorded pressure data, whether the particular well bore was optimally (radially) fractured. Additionally, this information provides rock formation data for use in modifying, in the field, the propellant characteristics by using various propellant modules of a different chemical composition for use in subsequent fracturing of the same or other well bores in the same field or formation. This data interpretation is essential to provide a propellant that will produce an optimum pressure build-up over time to be within the dynamic window of a particular formation.

BRIEF DESCRIPTION OF THE DRAWINGS

These and other objects and features of the present invention will become more apparent taken in conjunction with the accompanying drawings.

DETAILED DESCRIPTION

Figure 1:
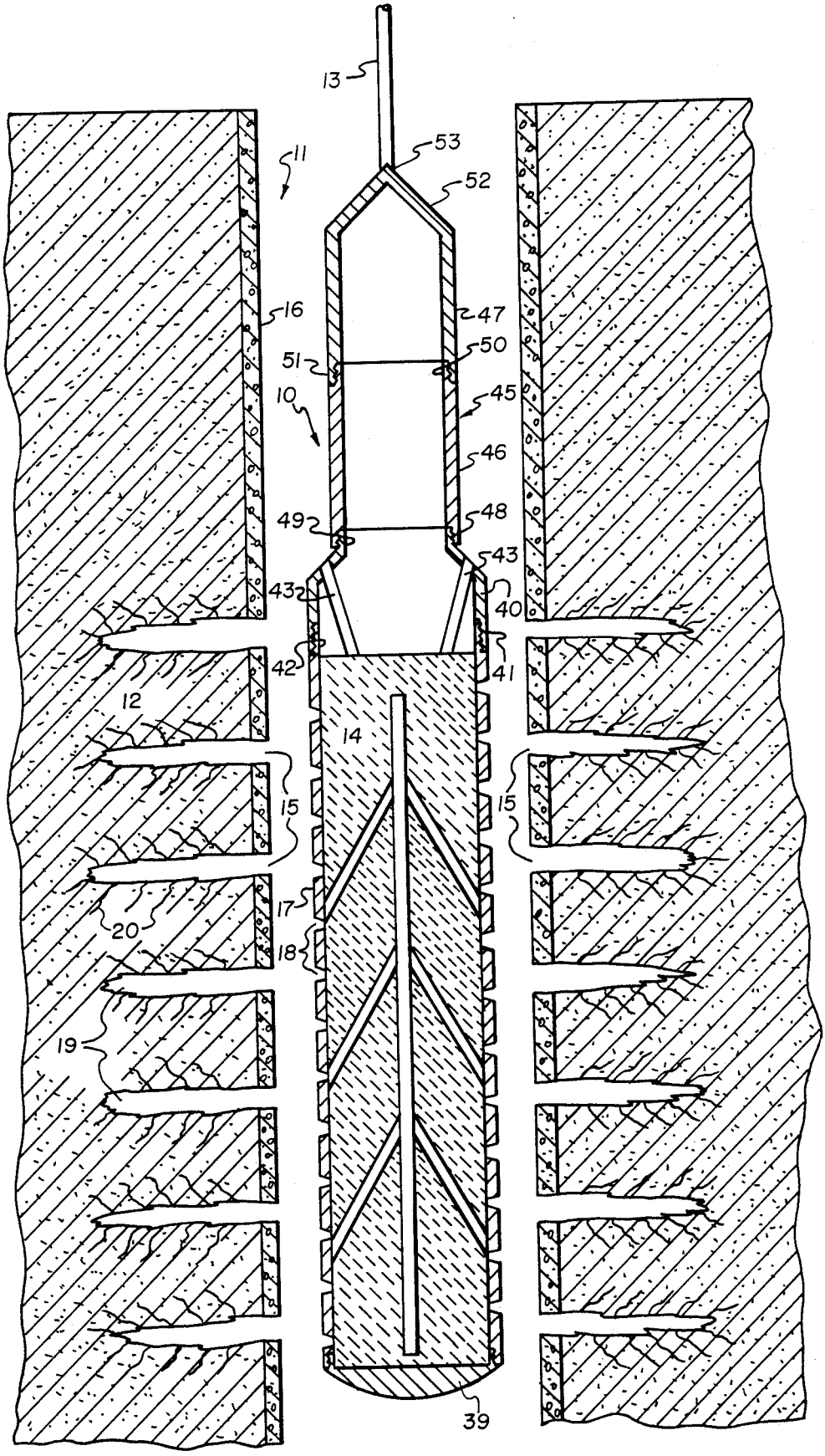
FIG. 1 is a perspective view of a section of a well bore that is shown to have been perforated, with a radial fracturing tool of the present invention shown suspended from a wire line therein showing the tool positioned immediately opposite to the well bore perforations.
Figure 2:
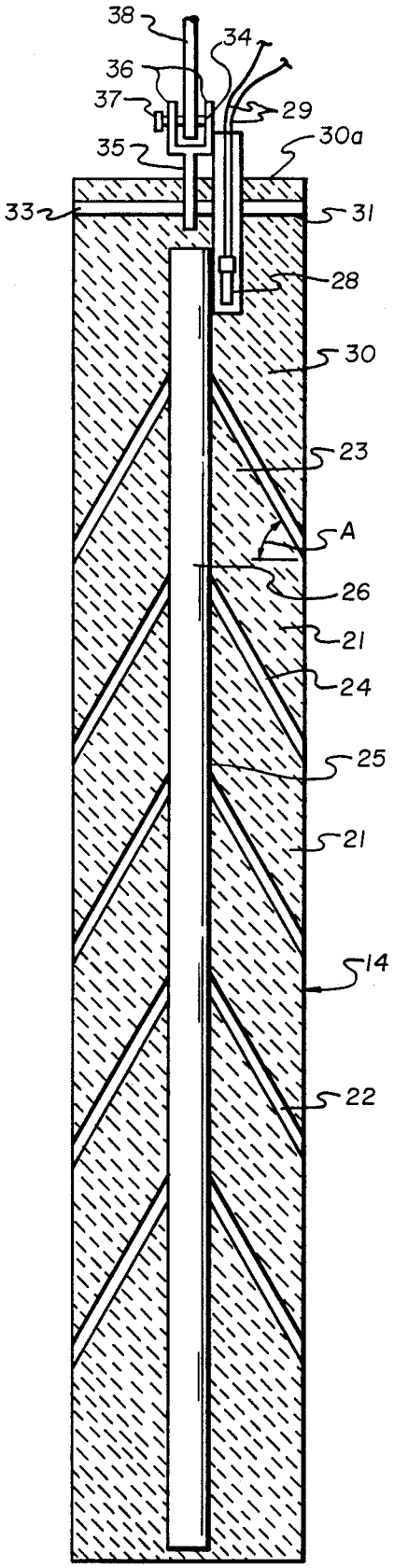
FIG. 2 is a longitudinal sectional view of a series of propellant modules contained within the cylindrical carrier of the radial fracturing tool of FIG. 1, which propellant modules are shown stacked therein and are each uniformly tapered into a cone on an upper face with the under or lower face shown as including a conical depression formed therein, the modules nesting one on another and showing an ignitor rod extending the length of the propellant, a detonator and a propellant hanger assembly.

FIG. 1 shows a preferred embodiment of a radial fracturing tool 10 of the present invention, hereinafter referred to as "tool 10". In FIG. 1, tool 10 is shown suspended within a well bore 11 that should be understood as extending from ground level into a rock formation 12. The tool 10 is shown lowered on a wire line 13 through a static fluid head into position adjacent to a location within that well bore where radial fracturing is to take place. The tool 10 is shown in FIG. 2 to contain a propellant 14 within a carrier 17 that, when ignited, will generate a high pressure and volume of gas by deflagration of that propellant. Illustrated in FIG. 1, the generated gases resulting from propellant combustion are at near sonic velocities and are directed through holes 18 formed in a propellant carrier 17. The generated gases pass through perforations 15 formed in a well bore casing 16 both further opening existing fractures and clearing or cleaning out blockages of materials as may have been deposited in existing fractures. The high velocity jets of gas pressure fracture the formation 12, illustrated as major fractures 19 with sub or smaller fractures 20 emanating therefrom. Both the well bore perforations 15 and holes 18 in propellant carrier 17 are radial and at spaced intervals. Additionally, the holes 18 preferably slope outwardly to provide a nozzle effect.

When the propellant 14 is ignited a high volume and pressure of gas is immediately generated and continues over a time period (in milliseconds) creating multiple radial fractures into the surrounding rock matrix or formation 12. Providing that the propellant burn rate is within a formation dynamic window, as discussed hereinbelow, the fractures will extend an optimal distance into that formation, significantly increasing the formation permeability at that depth.

In preparation for fracturing the characteristics of the rock formation surrounding a specific well bore where a fracture is to be initiated are ascertained, which data can be core data or data as produced by use of the tool 10 in fracturing a well bore in that formation. The pressure data produced in such fracturing attempt is then used in determining the propellant characteristics needed to achieve the formation dynamic window, as will be set out in detail later herein. When the dynamic window for a particular formation is achieved, that well bore will be optimally radially fractured without producing a zone of compaction as could occur as when explosive fracturing is utilized.

Figure 8:
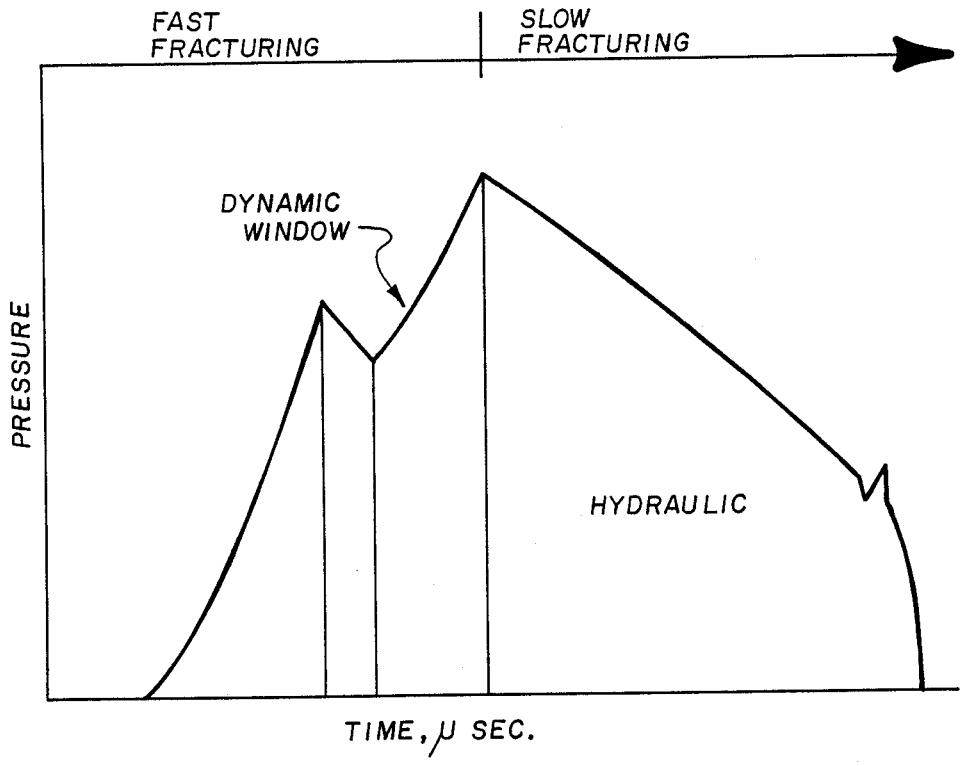
FIG. 8 is a graph showing pressure over time for a propllant deflagrating in a well bore illustrating a dynamic window for a particular rock formation.

Typically, the dynamic window, as set out above, and as shown in FIG. 8, and as will be discussed later herein, can be shown as an area of a graph that sets out pressure over time, the dynamic window shown as a first point in time when pressure is increased following a sharp decline and continuing to increase until the second peak pressure point is obtained. Generation of a pressure, volume and velocity of gas, within this time provides optimal (radial) formation fracturing and increased permeability without compaction of the surrounding rock that could limit rather than increase permeability as is a desired result from a use of tool 10 of the present invention. If the generated gas is not within the formation dynamic window, there will either be no fractures initiated, or the fractures initiated will not be radial (i.e., emerging in all directions from the well bore) or the rock formation will be compacted resulting in a decrease of permeability. In deflagrating propellant fracturing, the product of the burning (deflagrating) propellant will be a combination of gas and water that is under pressure and is near sonic velocity.

Knowing the characteristics (elasticity, tensile strength, in situ stresses, etc.) of the formation to be fractured provides data to design an optimum propellant matrix so as to attain multiple radial fracturing.

As shown in FIGS. 1 and 2, the tool 10 includes the propellant canister or carrier 17. The carrier 17 is preferably constructed from a very strong steel such as S.A.E. 4130 steel that has been tempered or otherwise hardened to withstand the internal pressures as are generated by a deflagrating propellant. The gases and water generated in that burn to pass out of radial openings or holes 18 that are spaced apart at intervals longitudinally and around the carrier. The gas from holes 18 is to pass through perforations 15 formed in well bore casing 16, as shown in FIG. 1 and into the formation 12.

Figure 7:
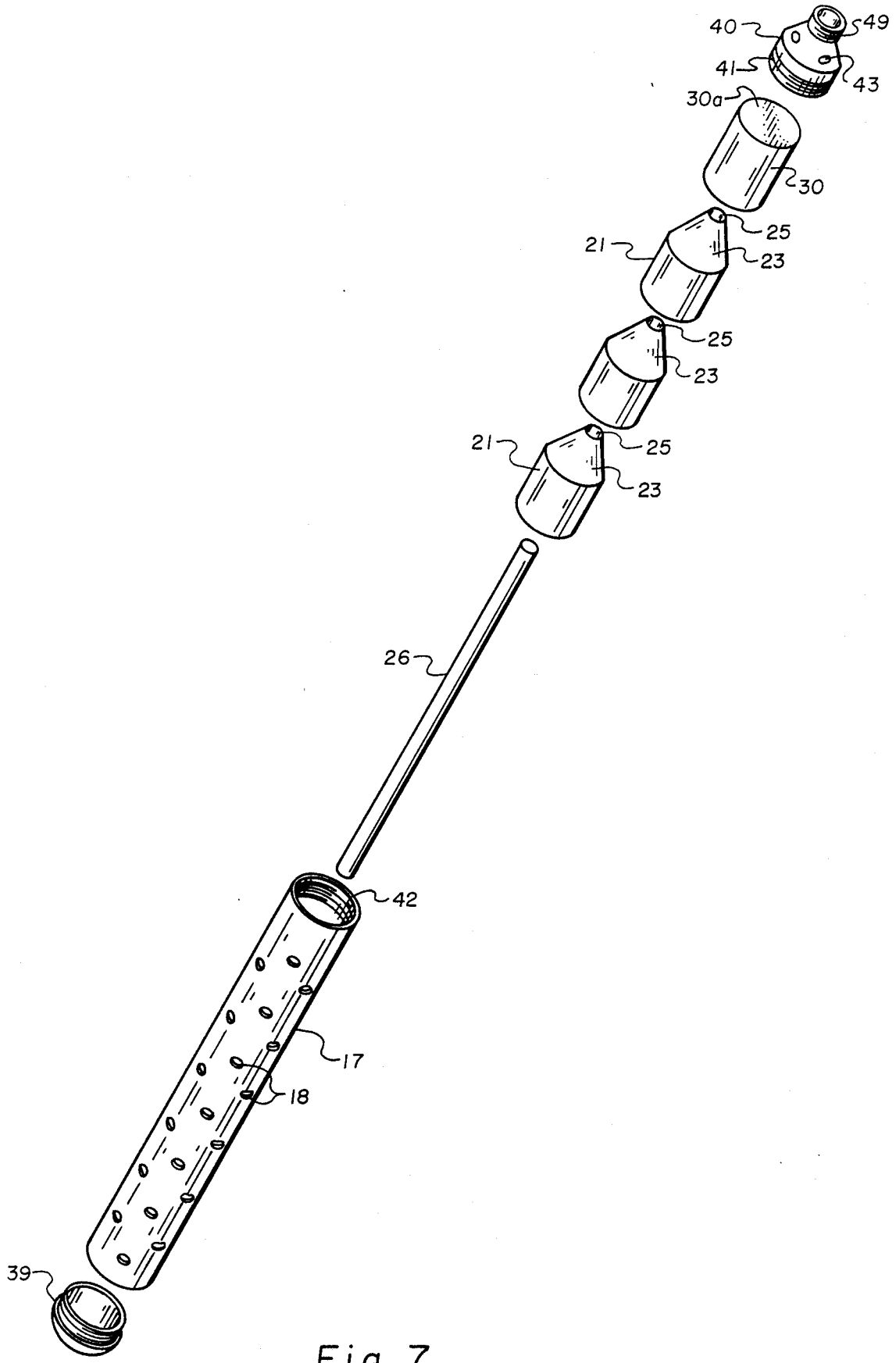
FIG. 7 is an exploded perspective view of the carrier and propellant modules of FIG. 2 shown exploded apart, the center longitudinal openings of each aligned to receive an ignitor rod, and showing the reverse thruster assembly and bull nose of FIG. 1 exploded off the opposite ends of the carrier.

Within the propellant carrier 17, as shown in FIGS. 1, 2 and 7, the stack 14 is shown to consist of individual propellant modules 21 hereinafter referred to as "module". Each such module 21 is individually formed, preferably by casting to the shape shown best in FIG. 7. The modules are arranged to nest on one another forming the propellant stack. Preferably, an epoxy resin wherein are mixed particles or granules of a fast burning propellant, as shown best at 22 in FIG. 2, is used to bond the propellant modules together. To promote a tight fit of the nested modules 21 so as to discourage gas blowout or leakage at a seam, the individual modules are identically fabricated to have identically angled converse upper face 23 and concave lower face 24, preferably, formed to have a flat cone shape. The flat cone converse and concave faces are formed at an angle of between forty-five degrees (45°) to seventy-five (75°) to the horizontal, with a preferred angle shown in FIG. 2 as angle A as sixty degrees (60°). With the module faces formed at an angle in the preferred range of angles, the respective mating upper and lower faces of the modules 21 will be sufficiently angled from the horizontal at forty-five degrees (45°) and above to discourage a flame front from burning laterally therethrough. The preferred range of angles discourages the flame front from diverting into a seam between modules. At an angle of seventy-five degrees (75°) or greater the module junction seam would be so long as to encourage the flame front to break through the areas at the junction ends, diverting from its lateral travel and producing thereby an uneven burning. In combination with the nesting module surfaces the invention provides for bonding the modules together as with an epoxy resin wherein propellant granules are mixed. The module nesting along with the epoxy bonding provides a seam wherethrough that propellant burn will be uniform so as to achieve the dynamic state to optimally fracture a formation. The resin, when dry, contains the propellant or explosive particles to as nearly as possible duplicate the propellant stack burn characteristics.

As will be discussed in detail hereinbelow, propellant stack 14 is constructed to produce, after ignition, a volume of gas at a pressure over a time certain that will be within a formation dynamic window as determined for a particular formation. The propellant stack, as shown in FIG. 2, is formed by bonding together propellant modules 21, the stack to exhibit characteristics of burn and resultant gas and water generation over time to achieve a gas pressurization rate that is within the action dynamic window. Propellant module casting preferably occurs in a factory setting where the modules chemical components and geometry are selected and the module identified as providing, when burned, a particular characteristic of gas generation over time (i.e., fast, slow, moderate). Knowing the individual module characteristics enables field modification of the propellant stack so that, when burned, the stack will provide the desired gas generation over time to be within the dynamic window for that formation. In practice, propellant modules have been cast from a mixture of oxidizer, fuel and a bonding resin, at ratios of 5 to 12 to 1. By varying the ratio of oxidizer to fuel between 12 to 1 and 5 to 1 modules whose deflagration characteristics range from fast pressurization rates (<5 milliseconds) to slow pressurization rates (>30 milliseconds) have been constructed. So arranged, with modules of uniform volume a propellant stack 14 can be constructed having certain characteristics by selection of modules 21 whose average burn characteristics will be those that generate a pressurization rate within the dynamic window. The dynamic window referred to above, as shown in FIG. 8, is defined as the range of energy loading (pressurization rate) exerted on a material (rock) that exceeds static loading rates by such a degree that the material is fractured in multiple planes rather than the plane of least resistance yet below loading rates that exceed all tensile and compressive strength of the material and thereby causes compaction and crumbling. Mathematically this can be expressed as $$\frac{\pi D}{2C_R} < i_m < \frac{8\pi D}{C_R} \quad (1)$$

where $C_R$ is the Raleigh surface-wave velocity and D is the bore hole diameter. It is well known that this equation holds for any rock type whose Poisson's ratio is in the vicinity of 0.3. The term at the left in Equation 1 is a derived result that represents the boundary between the multiple- and explosive-fracture regimes. The term at the right represents the boundary between the hydraulic- and multiple-fracture regimes. This term was derived by assuming the same scaling relationship used for the multiple-explosive boundary, but with a different multiplying factor. The multiplying factor was determined empirically.

Shown in FIG. 2 the propellant modules 21 have central holes formed longitudinally therethrough at 25. Holes 25, when the modules are stacked together, provide a continuous longitudinal passage to receive an ignitor rod 26 inserted therein. The ignitor rod is preferably formed of aluminum tubing that is filled with a sensitized propellant composition and will be ignited by the exploding of a side firing electric detonator or blasting cap 28 located adjacent thereto. The blasting cap is linked by wire 29 to the surface.

As set out above, and as shown in FIGS. 1 and 2, the modules 21 are contained within a carrier or casing 17 that is preferably fabricated from a steel or like material having a sufficient wall thickness and strength that it will not be destroyed during the propellant deflagration. During propellant deflagration the gas and water produced will pass from the casing out through the ports 18 into the surrounding rock formation 12. The ports 18 are preferably two inch holes drilled horizontally or at ninety degrees (90°) to the carrier 17 surface over the entire length thereof and have the edges thereof sloped outwardly to minimize the forces as are exerted therearound by the deflagrating propellant.

Figure 6:
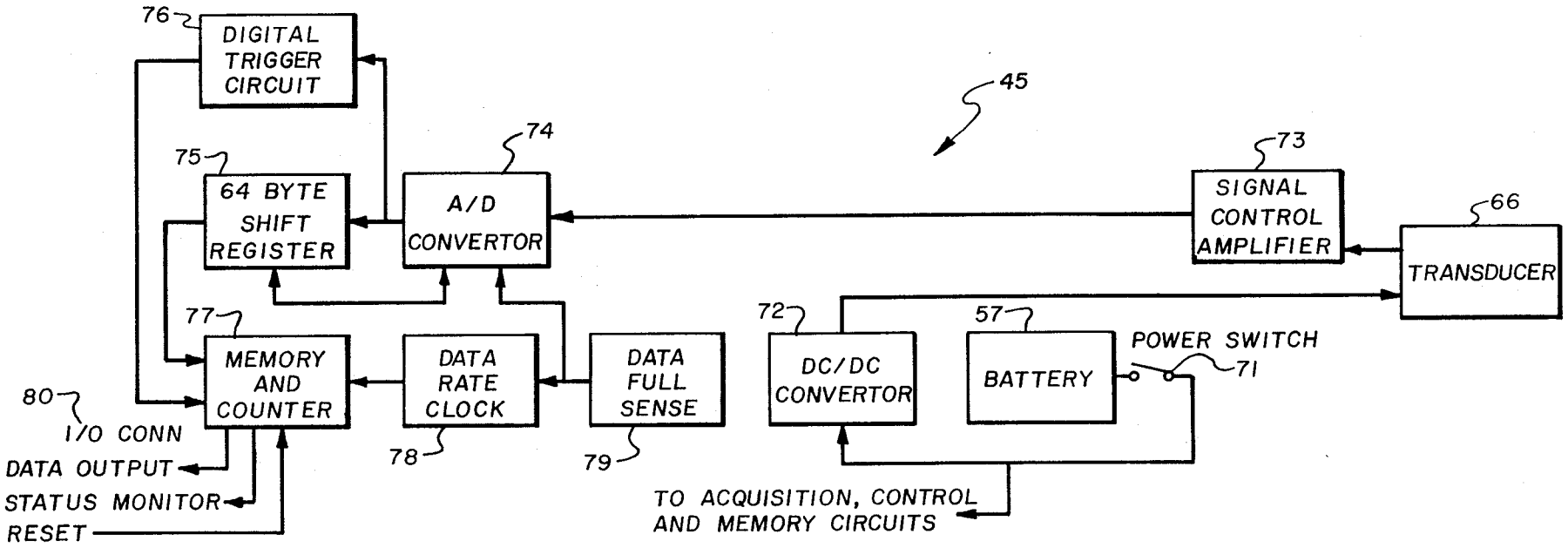
FIG. 6 is a block flow schematic showing the components contained in the pressure pulse monitor housing of FIGS. 3, 4 and 5, respectively, the blocks shown arranged in a longitudinal configuration to represent that they are contained in the cylindrical housing of the pressure probe.

To provide propellant ignition, the electric detonator or blasting cap 28 is detonated by passage from the surface of an electrical pulse or impulse through wires 29. Detonator ignition ignites the propellant grains within the aluminum ignitor rod 26 that ignites the propellant stack 14 along its longitudinal center opening 25 providing an outward or radial burn. The blasting cap detonation additionally promotes a cigarette type burn from the top down of an adjacent ignition propellant module 30. Ignition propellant module 30, as shown in FIGS. 2 and 6, is the crown or cap of the propellant stack 14 and has a flat top surface 30*a* with the same concave under surface as do propellant module 21. The initiator module 30, as shown in FIG. 2, includes a lateral port 31 formed therethrough to align with opposite holes or openings 32 in the carrier 17 to receive a hanger anchor pin 33, as shown best in FIG. 7, that is fitted therethrough and through an opening or hole in a lower leg 35 of a "Y" hanger 34. The "Y" hanger has, as shown, two parallel legs 36 that face or extend oppositely to lower leg 35 and are each holed near the ends thereof to receive a hanger pin 37 fitted therethrough. The hanger pin 37, in turn, receives a hanger 38 that is preferably a rectangular shaped aluminum stock material that is drilled with elongated holes to be compatible with the commonly used firing heads of a collar located. Hanger 38 is anchored to the ignitor module and is for supporting and positioning the propellant stack 14 as it is lowered into the well or is positioned in the tool carrier 17.

The lower end of the tool carrier 17, as shown in Figs. 1 and 7 is fitted with a bull nose 39. Bull nose 37 is preferably fabricated from a strong material such as a hardened steel to withstand contact with the well bore casing as it experiences in lending the tool 10 into the well bore during lowering of that tool into the well bore and positioning adjacent to the formation to be fractured. The bull nose 39 preferably tapers at approximately a thirty degree (30°) angle to the horizontal to a flat center section and is to assist in negotiating the tool past obstructions as may exist in the well bore casing.

As shown best in FIGS. 1 and 7, a reverse thruster housing 40 is connected to the carrier 17 top end as by turning an externally threaded end 41 thereof over an internally threaded upper end 42 of that tool carrier.

The reverse thruster, like the tool carrier 17, is preferably formed from a hardened steel and is capable of withstanding, without damage, the forces exerted therein by the deflagrating propellant. The reverse thruster housing 40 includes reverse thruster ports 43 that pass gas under pressure generated by propellant deflagration. Shown in FIG. 1, the ports 43 are preferably formed at equal intervals around the head end of the reverse thruster assembly, each hole at approximately a fifteen degree (15°) angle from the vertical. So arranged, the gas exhausted through the ports 43 exerts a force on the tool 10 that tends to urge it downwardly, against the wire line. This force application prevents upward movement of the tool 10 as could result from a lifting force on the tool produced by the gas flow that is directed out of the horizontal openings 18 in carrier 17. The tool 10 is thereby stabilized to remain essentially stationary within the well bore during propellent deflagration. Stabilizing the tool 10 within the well bore insures that the pressure build-up generated by the propellant deflagration will continue to be directed against the perforated portion of the well bore casing, over the period of the propellant burn, and also provides for stabilizing a pressure pulse monitor 45, discussed in detail hereinbelow, is secured to that reverse thruster assembly, at an upper or top end of tool 10.

As shown in FIG. 1 and in the exploded view of FIG. 7, the tool 10 preferably includes a pressure pulse monitor 45 that is contained within a casing or housing 46. Casing or housing 46 is secured at its lower end to the reverse thruster housing 40 and has it's upper end maintained to a collar locator 47. The pressure pulse monitor 45 is more fully shown in the sectional view of FIG. 3 and in the enlarged sectional views of FIGS. 4 and 5. The pressure pulse monitor housing 46 is preferably coupled to the reverse thruster housing 40 by turning a threaded open end 48 of that assembly over threads 49 formed around the head or top end of that reverse thruster housing. The pressure pulse monitor housing 46 upper end is in turn secured to the base or bottom end of the collar locator 47 by turning a threaded end 50 of that housing 46 into a threaded recess 51 formed in the bottom of that collar locator 47. The collar locator 47, shown best in FIG. 1, includes a hanger assembly 52 that slopes inwardly to an apex 53 whereat the wire line 13 is coupled. Such coupling may be like the hanger assembly described in FIG. 2 wherefrom the propellant module stack is suspended or may be another appropriate coupling for maintaining that tool 10 to the wire line 13. The collar locator 47 is a standard item for inclusion with devices to be lowered into a well bore for locating a point therein and so will not be described in detail. A collar locator manufactured by Gearhart identified as $1\frac{7}{8}$" CCL has been successfully used in practice as part of tool 10.

Figure 3:
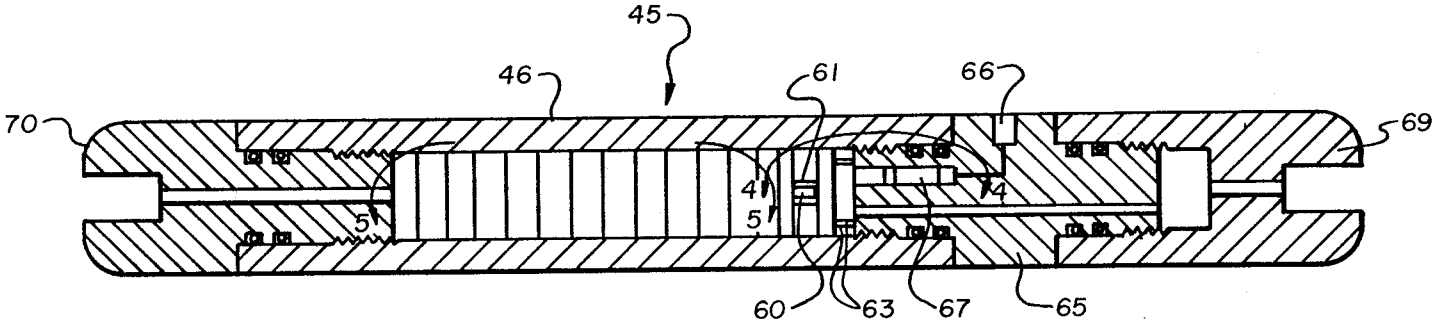
FIG. 3 shows a cross-sectional view of the pressure pulse monitor portion of the radial fracturing tool of FIG. 1.
Figure 4:
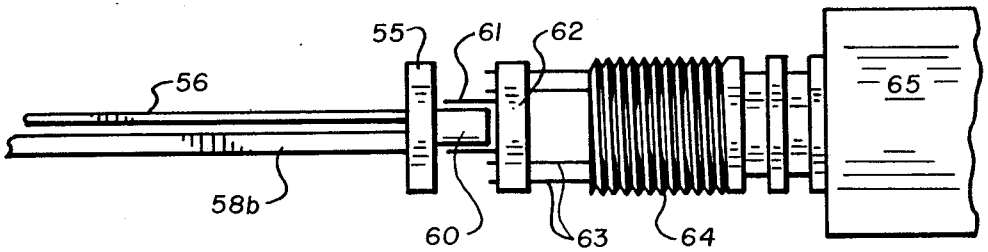
FIG. 4 shows a sectional view taken within the line 4—4 of FIG. 3 exposing a transducer bulk head end of the pressure pulse monitor housing and illustrates the coupling arrangement for joining the pressure sensing portion thereof to a circuit board.
Figure 5:
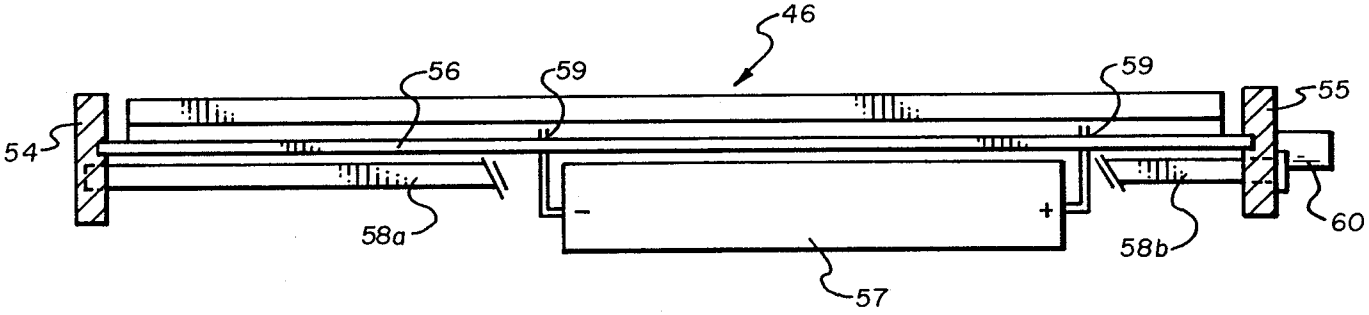
FIG. 5 shows a cross-sectional view of a battery and circuitry portion of the pressure pulse monitor housing taken within the line 5—5 of FIG. 3.

Shown in FIG. 3, the pressure plate monitor 45 is contained in sections within the casing 46, which casing, it should be understood, is formed from a strong material such as a hardened steel. Further, it should be understood, the pressure and electrical components contained therein are securely mounted or ruggedized to prohibit or limit a potential for damage of those components during propellant deflagration. For example, FIG. 5 is a sectional view of an end portion of housing 46, and shows a longitudinal plate 56 suspended at its ends between a base end plate 54 and a head end plate 55. The plate 56 is a printed circuit board that contains certain of the electrical components of the pressure pulse monitor 45 as will be discussed later herein with respect to the schematic of FIG. 6. Along with the printed circuit board 56 the housing of FIG. 5 is shown to contain a battery 57 that is arranged between support rails 58*a* and 58*b*. The battery 57 is shown to connect to the circuit board through lines 59, as will be discussed later herein with respect to the dicussion of the schematic of FIG. 6. A pin 60 is shown in FIGS. 3, 4 and 5 as extending from the head end plate 57 that is for connecting, respectively, the battery 57 and the electrical components of the circuit board 56 to a pressure transducer 66 of the pressure pulse monitor 45. Shown in FIG. 4, pin 60 is arranged to receive a collar connector 61 that is fitted thereover, making an electrical connection, which collar connector 61, in turn, connects to a connector head 62. The connector head 62, in turn, connects by wires 63 to a threaded coupling end 64 of a pressure transducer bulk head 65. A pressure transducer 66 is contained within the pressure transducer bulk head 65, as shown in FIG. 3 with it's function described in detail in the block schematic of FIG. 6, hereinbelow.

In FIG. 3 the pressure transducer bulk head 65 is shown to contain pressure transducer 66 along with a signal amplifier 67 that are shown as boxes. The pressure transducer 66 is preferably a Quartz pressure transducer that is commercially available and will sense pressure pulses up to 60,000 PSI, such as a PCB mode 1 109A Transducer. The pressure transducer is in contact through a port with the environment outside of the upper portion of housing 46 to sense pressure changes as occur outside the tool. Such pressure changes are converted to electrical pulses that are amplified by the signal amplifier 67 and are for transmission through wires 63 and collar coupling 61 through the pin 60 and into the electrical components contained in the lower portion of casing 46. Shown in FIG. 3, the forward and rear ends 69 and 70, respectively, of the pressure pulse monitor housing 46 include packing seals for insuring housing integrity and are each notched centrally thereacross for receiving pins, not shown. So arranged, the arrangement of ends 69 and 70 are an alternative to the screw couplings of the housing 46 components shown in FIG. 1. Such arrangement provides clevis type couplings that allow for some pivotal freedom of movement between the collar locator 47 and pressure pulse monitor 45, the pressure pulse monitor and the reverse thruster housing 40, facilitating the tool 10 "snaking" around obstructions as it may encounter in its being lowered down the well bore.

In FIG. 6 is shown a block flow schematic that includes certain of the components described above such as the battery 57 and pressure transducer 66, and further shows the preferred circuitry arrangement of the pressure pulse monitor 45. These components are contained, as shown in FIGS. 3, 4 and 5 in the pressure pulse monitor housing 46.

FIG. 6 shows a schematic of the pressure pulse monitor 45. In operation, battery 57 provides a D.C. voltage that passes through a power switch 71 that is shown to energize acquisition control and memory circuits. Power is thereby provided to a DC/DC converter 72 that generates a high voltage to operate transducer 66. The transducer 66 output does not operate until it generates upon it's sensing a pressure pulse of sufficient intensity. When such intensity of pressure pulse is sensed, that sensing is applied to a signal control amplifier 73 which is calibrated to produce a full scale output that is proportional to the full scale pressure range of the transducer 66. The amplified signal is then applied to the input side of an analog-to-digital (A/D) converter 74 that will run continuously with the application of power, thereto, which power is applied through power switch 71. This (A/D) converter 74 can be reset through a I/O converter 80, as set out below The output of the A/D converter 74 is applied to both a 64 byte shift register 75 and a digital trigger circuit 76 that is bit weighted. When operated in a standby mode, prior to sensing a pressure pulse, the 64 byte shift register 75 accepts data from the A/D converter 74. The shift register data when received, however, will not be loaded into memory until receipt of a valid signal is passed from the transducer 66. Once such input signal exceeds a preset level as programmed into the digital trigger circuit 76, the output therefrom will cause the memory and counter circuits 77 to be enabled. The 64 byte shift register 75 output will then begin to load into memory. At this time the data residing in the shift register, which data was generated prior to the receipt of the trigger signal and constitutes the pre-zero data is loaded into memory. As the memory portion of the memory and counter 77 fills the address counter thereof will cause a data full sense circuit 79 to toggle which, in turn, stops a data rate clock 78 and the A/D converter 74. At this time, essentially all circuitry of the pressure pulse monitor 45 will be is disabled, and will remain disabled until a reset command is generated. This full sensing is passed from the memory and counter 77 to the data full sense 79, and both disables the data rate clock 78 and the A/D converter 74. Thereby, the received data is stored in memory until it is later retrieved after the tool has been returned to the surface as by a computer interrogating it through the I/O connector 80, which I/O connector 80 is also used to reset the circuit.

In practice, to radially fracture a particular formation, the well bore casing 16 is first perforated at a level where fracturing is to take place and any materials collected thereat or above are removed and the tool lowered into that well bore 11. The tool 10 is lowered into the well bore to a depth wherein is located a particular rock formation as determined by the collar locator 47. Prior to lowering the tool 10 into the well bore, the actual or estimated characteristics of that rock formation are determined and are used to construct a propellant stack 14. The propellant stack is assembled from propellant modules 21 and is such that deflagration of that propellant over time will produce a volume and pressure of gas to be within the dynamic window of the rock formation, see FIG. 8. Provided the pressure is within the formation dynamic window, as shown in Fig. 8, that formation will be optimally radially fractured. In the event that the fracturing as determined by an interpretation of the data collected and stored by the pressure pulse monitor 45 is not determined to be optimally successful in a first attempt, the tool 10 is field modified by selecting another propellant stack configuration to re-fracture the formation. In practice, a second or even third tool 10 can be so modified until the pressurization rate falls within the dynamic window, and thus the optimum (radial) fracture pattern is achieved.

With the characteristics of the rock formation known, a the propellant stack 14 can be constructed to meet the dynamic window of that formation. In such fabrication, the aligned center longitudinal cavity of the propellant modules 21 are each slid along the ignitor rod 26, which propellant modules are each identified to have certain burn characteristics, are individually selected, and are assembled and bonded together into the propellant stack 14, which propellant stack will have the desired deflagration characteristics for the particular formation.

With the characteristics of the formation known, and after determination of the particular propellant modules 21 to be assembled into the propellant stack 14, the modules arranged the ignitor rod 26 are bonded together using an epoxy resin wherein explosive or propellant grains are suspended. The propellant stack 14 is then lowered within the tool carrier 17. Thereafter, the tool 10 is assembled and consists of the collar locator 47, that is fixed atop the pressure pulse monitor 45, that connects to the reverse thruster assembly 40 that connects to the carrier 17.

The assembled tool 10 is lowered on a wire line 13 from the surface into the well until, as determined by the collar locator 47, it is adjacent to the formation whereat radial collar locator that transmits a low voltage electrical signal through the wire line. To provide such signal transmission the wire line 13 also includes a cable for passing electrical signals, one of which signals is to the electrical detonator or blasting cap 31 that is exploded to ignite the propellant stack 14.

Once the carrier 17 containing the propellant stack is spotted next to the perforated zone of the well, shown at 15 in FIG. 1, the detonator or blasting cap is ignited which, in turn, ignites the propellant in the ignitor rod 26 that triggers radial burning from the propellant longitudinal cavity and also triggers, with the first pressure pulse by the pressure transducer 66, the operation of the pressure pulse monitor 45. The burning propellant deflagrates radially with some longitudinal burning occurring from the blasting cap's ignition, particularly at the propellant initiation module 30. The propellant initiation module 30 provides gas under pressure that, in part, passes through the reverse thruster nozzles 43. After ignition of the ignitor rod 26, propellant burning proceeds radially generating $CO_2$ gas and water over time. The burning (deflagrating) propellant will be well progressed within five (5) milliseconds and the propellant is usually totally consumed within ten (10) to forty (40) milliseconds. The gases produced by the deflagrating propellant exit the gas ports 18 in the carrier 17 in a turbulent flow that enters the formation through casing perforations, creating a super turbulent flow in that formation. Providing the empirical design for the targeted formation was in fact within the perceived dynamic window for that formation, multiple radial fractures, illustrated at 19 and 20 in FIG. 1, will be initiated by this propagating gas.

During the propellant burn, the pressure build up over time, also identified as "pressure rate", which pressure rate will be measured and recorded, as described above, by the presssure pulse monitor 45. This pressure data is retrieved by a computer when the tool 10 is brought to the surface and interrogated. Further, during the burn, the entire string will be essentially held in place by the force of gas expelled through the reverse thruster assembly ports 43, that force acting against a tendency that the tool 10 may have to lift up the well bore responsive to the tool being spotted typically close to the total depth of the well. The gases act on the well bottom to lift the tool and fluid column it is surrounded and suspended in toward the surface. After use the entire tool 10 is pulled from the well bore and can be reused by assembling and installing a new propellant stack 14 of modules 21 therein and resetting the pressure pulse monitor 45. The burn characteristics of which propellant stack 14 are determined from an analysis of the pressure data recorded by the pressure pulse monitor 45.

The pressure data, as illustrated in the graph of Fig. 8, is provided at the surface the I/O connector 80 of the pressure pulse monitor 45 that is connected by an electrical cable to a computer. The computer, not shown, may be a personal computer, or the like, and is used to interrogate the pressure pulse monitor that passes the collected and recorded pressure data that it has received during propellant deflagration to the computer for plotting a pressure vs. time curve. From this information the dynamic window for the formation can be determined as well as whether optimal radial fracturing was achieved. In the event that it is determined that optimal results were not achieved, the next tool 10 can be field adjusted by altering the propellant modules. Thus, if the pressure pulse monitor indicates that the burn rate and thus pressurization rate was too fast and similar to an explosion causing compaction a slower burning propellant module will be chosen from a selection of modules at the field location and thus assembled as described above. In like manner, if the original attempt as recorded by the pressure pulse monitor was too slow to be within the dynamic window, faster burning propellant modules can be selected and field fabricated for subsequent runs. This methodology can also be employed for special applications, such as utilizing a prolific gas volume generating module to further extend the fractures once operation within the dynamic window has been established.

The present invention is in a radial fracturing tool and method for its use that has been shown described herein as preferred form. It should, however, be understood that the invention may be embodied in other specific forms without departing from the subject matter, coming within the scope of following claims, which claims I regarded as my invention.

I claim:

1. A tool for stimulating a subterranean formation comprising, an elongate propellant stack constructed from propellant material modules that are formed from a combination of propellant materials such that the propellant module combination will have a desired burn rate, propellant modules of a center portion to have identical convex and concave surfaces as the respective top and bottom faces thereof with end propellant modules to form the propellant stack ends each having an end face to fit within or over one of said center portion propellant modules convex or concave faces; adhesive means containing grains of a propellant or explosive mixed therein to provide a burn rate that is approximately that of the propellant stack for bonding said selected propellant modules together, said adhesive means to burn with the propellant stack; means for supporting and lowering said propellant stack into a well bore to a subterranean formation to be stimulated; and means for igniting said propellant stack.

2. A tool as recited in claim 1, wherein the propellant module stack is cylindrical and said propellant modules opposite top and bottom convex and concave shapes are identical right circular cones, the hypotenuse side of which cone is at an angle of between forty-five degrees (45°) to seventy-five degrees (75°) to the horizontal.

3. A tool as recited in claim 1, wherein the adhesive means is an epoxy resin.

4. A tool as recited in claim 1, wherein the top end propellant module is an ignitor propellant module having the convex undersurface and a flat top surface.

5. A tool as recited in claim 4, wherein the means for supporting and lowering the propellant module stack is a hanger means consisting of a "Y" hanger the single leg end thereof for securing to the ignitor propellant module, and the two legs thereof are parallel and are each holed to receive a hanger pin fitted therethrough, and wherein the means for supporting and lowering said propellant module stack into a well bore is a wire line that includes an end coupling means for receiving said hanger pin fitted therethrough.

6. A tool as recited in claim 1, wherein the means for igniting said propellant stack is, a center longitudinal cavity formed in the propellant stack wherein is fitted an ignitor rod that contains a propellant ignitor material; blasting cap means located adjacent to said ignitor rod; and means for remotely exploding said blasting cap means to ignite said ignitor rod.

7. A tool as recited in claim 6, wherein the means for lowering said propellant stack in a well bore and for remotely igniting said blasting cap means is a wire line that supports said tool and is connected to pass an electrical current from the surface to said blasting cap means.

8. A tool as recited in claim 1, further including a cylindrical canister for containing the propellant stack, which canister is holed therearound over it's length for passing gas under pressure as is generated in propellant deflagration.

9. A tool as recited in claim 8, wherein the holes formed in the canister from the inside canister surface are sloped outwardly.

10. A tool as recited in claim 8, further including a bull nose means for fitting over the end of the canister opposite to the wire line connection, and is formed of a strong material to withstand damage as the tool is lowered into the well bore.

11. A propellant stack constructed from individual propellant modules each formed to have a specific burn rate, the combining of which propellant modules in a single stack to provide a propellent having a certain burn rate comprising, propellant modules each formed from a combination of propellant materials to have a certain burn rate, which propellant modules for a center portion of said stack are identically cylindrically shaped and each has, respectively, a regular convex top surface to fit exactly within an opposite identical regular concave undersurface, the angle of which regular convex and concave surfaces is between forty-five degrees (45) and seventy-five degrees (75) to the horizontal; top and bottom end propellant modules formed from the same combinaton of propellant material as said center portion propellant modules each having an end surface to exactly fit within an opposite regular concave or convex surface of a propellant module of said center portion; and binding means for joining together the modules contacting regular convex and concave surfaces, which binding means is a resin containing propellant or explosive particles to have a burn rate that is like that of the propellant stack.

12. A propellant stack as recited in claim 11, wherein the convex and concave opposite faces of each propellant module are right identical circular cones.

13. A propellant stack as recited in claim 12, wherein the hypotenuse side of the right circular cones is at a sixty degree (60°) angle to the horizontal.

14. A propellant stack as recited in claim 11, wherein the propellant modules each include a center longitudinal opening, which openings, when the propellant modules are stacked together, align into a center longitudinal opening; and ignitor means for installation in said center longitudinal opening to ignite said propellant stack to burn radially outwardly from said center longitudinal opening.

15. A propellant stack as recited in claim 11, wherein the bonding means is an epoxy resin wherein propellant or explosive particles have been mixed.

16. A tool for stimulating a subterranean formation comprising, a cylindrical canister that is radially holed therearound over its length and is to contain a propellant stack fitted therein that is formed from propellant modules selected to provide a certain burning rate when ignited, which propellant modules are bonded together with an adhesive material to have a burn rate that is approximately that of the propellant stack; means for igniting said propellant stack at its longitudinal center to burn radially therefrom; a pulse monitor assembly for arrangement with said cylindrical canister that includes a pressure pulse sensor means for sensing pressure pulses as occur during propellant deflagration that includes means for recording in memory those pulses over time; wire line means for suspending said tool from the ground surface that includes means for passing an electrical current from the surface to ignite said propellant stack; and means for interrogating said pulse monitor assembly memory to retrieve and store the pressure date generated and recorded during propellant deflagration.

17. A tool as recited in claim 16, further including a reverse thruster assembly for coupling to said cylindrical casing end above said propellant stack and below said pressure pulse monitor assembly, said reverse thruster assembly having equidistantly spaced ports formed therethrough that are identically angled from the vertical and are arranged to receive and pass gas under pressure therethrough during deflagration of the propellant stack.

18. A tool as recited in claim 17, wherein the reverse thruster assembly ports are formed at approximately fifteen degrees (15°) from the vertical.

19. A tool as recited in claim 16, further including a collar locator means for sensing well bore casing collars for and passing that information to the surface over said wire line means for determining tool positioning within the well bore.

20. A tool as recited in claim 16, further including bull nose means to close over the lower cylindrical end, which bull nose means is formed from a material to withstand wear, said bull nose means for leading the tool as it is lowered into the well bore, with said bull nose means sloped at approximately a thirty degree (30 ) angle from the horizontal to have a flat conical shaped end surface.

21. A tool as recited in claim 16, wherein the propellant stack is formed by stacking a number of propellant modules, one on another, into a center portion with end propellant modules fitted to said center portion ends completing the propellant stack which center portion propellant modules are each flat cylinders having identical convex and concave opposite upper and lower faces, respectively, to nest one on the other forming the propellant stack with the end propellant modules to fit over the opposite propellant stack ends, with said propellant modules selected to have a desired burn rate.

22. A tool as recited in claim 21, wherein the module convex and concave faces respectively, are right circular cones having a hypotenuse side that is between forty-five degrees (45°) to seventy-five degrees (75°) to the horizontal.

23. A tool as recited in claim 22, wherein the hypotenuse side is at sixty degrees (60°) to the horizontal.

24. A tool as recited in claim 16, wherein the bonding material is an epoxy resin wherein has been mixed propellant or explosive particles to produce a desired burn rate.

25. A tool as recited in claim 16, wherein the individual propellant modules forming the center portion are center holed such that when formed into a stack, the center holes align to form a longitudinal center opening; the means for igniting said propellant stack along its longitudinal center opening is an ignitor rod that contains a propellant ignitor material and is fitted into the propellant stack longitudinal center opening, which ignitor rod is located adjcent to a blasting cap means; and blasting cap means that, upon receipt of an electrical signal from the surface, will explode, igniting the propellant ignitor material in said ignitor rod.

26. A tool as recited in claim 16, wherein the pressure pulse sensor means of the pulse monitor assembly is a pressure transducer having a sensor portion that is arranged to sense pressure pulses as are developed in propellant deflagration, said pressure pulses being amplified and converted to digital by components of said pulse monitor assembly for storage in the memory of said pulse monitor assembly.

27. A tool as recited in claim 26, further including a battery that is included with the pulse monitor assembly as an internal power supply; sensitivity triggers means for initiating pressure data recording upon sensing of a certain intensity of pressure pulse; and data full sense means for sensing when the memory is full and turning off said pulse monitor assembly.

28. A tool as recited in claim 16, wherein the means for interrogating said pulse monitor assembly memory is a personal computer that connects to an I/O connector of said pulse monitor assembly of the retrieved tool.

29. A process for stimulating a subterranean formation utilizing a high energy gas fracturing tool to optimally radially fracture the formation where the tool propellant charge is formed from individual propellant modules each having a known burn rate comprising the steps of, from an analysis of the known characteristics of the subterranean formation, selecting and combining individual propellant modules, each having a known burn rate, into a propellant stack, the propellant stack to have a certain burn rate such that propellant deflagration will produce gas and water at a pressure and velocity to be within a dynamic window of the formation to optimally radially fracture that formation; positioning the propellant stack to a pre-determined location within the subterranean formation; and igniting the propellant stack, the deflagrating propellant to appropriately fracture the subterranean formation alongside the propellant stack.

30. A process as recited in claim 29, further including bonding the propellant module mating surfaces together with an adhesive that has a burn rate that is approximately that of the propellant stack; providing an igniting means arranged in a center longituddinal cavity of the propellant stack; and igniting the igniting means to uniformly burn radially from that center longitudinal cavity outwardly.

31. A process as recited in claim 29, further including stabilizing the tool within a well bore during propellant deflagration utilizing a ported assembly that is connected to a tool body that contains the propellant stack, the ports of which ported assembly are equidistantly spaced and are angled uniformly from a vertical center axis to receive and pass gas under pressure therethrough during propellant deflagration, providing an opposite force to a lifting force as may be generating on said tool by the propellant deflagration.

32. A process as recited in claim 29 further including sensing and recording at the tool with a pulse monitor assembly pressure pulses as occur during propellant deflagration; and interrogating that pulse monitor assembly upon tool retrieval to obtain the pressure pulse data as occurred over time during propellant deflagration.

33. A process as recited in claim 32, further including utilizing the recorded pressure pulse data for calculating the formation dynamic window and determining whether the formation was optimally radially fractured.

34. A process as recited in claim 33, further including, where it is determined the formation was not optimally fractured from an analysis of the pressure pulse data, refracturing the particular formation location by selecting and combining certain propellant modules that are fitted together in a propellant stack, the propellant stack to have a burn rate that will be within the formation dynamic window; loading that propellant stack in a tool canister for positioning at a depth in the well bore so as to optimally radially fracture that formation; and igniting that propellant stack.

35. A process as recited in claim 33, further including utilizing the recorded pressure pulse data for predicting the dynamic window of other well bores in a formation to construct a propellant stack from select propellant modules for use in a tool to optimally radially fracture such other well bore.

* * * * *